US008210156B2

(12) United States Patent
Kokotovic et al.

(10) Patent No.: US 8,210,156 B2
(45) Date of Patent: Jul. 3, 2012

(54) FUEL SYSTEM WITH ELECTRICALLY-CONTROLLABLE MECHANICAL PRESSURE REGULATOR

(75) Inventors: Vladimir V. Kokotovic, Bloomfield Hills, MI (US); Ilya Vladimir Kolmanovsky, Novi, MI (US); Yan Wang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 338 days.

(21) Appl. No.: 12/605,805

(22) Filed: Oct. 26, 2009

(65) Prior Publication Data

US 2011/0000463 A1 Jan. 6, 2011

Related U.S. Application Data

(60) Provisional application No. 61/222,216, filed on Jul. 1, 2009.

(51) Int. Cl.
*F02M 59/36* (2006.01)

(52) U.S. Cl. ..... 123/458

(58) Field of Classification Search ..... 123/457, 123/458; 137/510, 495, 487.5; 251/336, 251/337

See application file for complete search history.

(56) References Cited

U.S. PATENT DOCUMENTS 2,594,405 A * 4/1952 Deters ..... 137/510
3,602,428 A * 8/1971 Lochner et al. ..... 236/93 R
3,927,654 A * 12/1975 Perr ..... 123/390
3,939,868 A * 2/1976 Logsdon ..... 137/517
3,949,714 A * 4/1976 Mitchell ..... 123/458
3,977,649 A * 8/1976 Zeuner et al. ..... 251/82
4,015,571 A * 4/1977 Stumpp ..... 123/457
4,015,572 A * 4/1977 Leshner et al. ..... 123/457
4,176,641 A * 12/1979 Perr ..... 123/390
4,222,713 A * 9/1980 DeKeyser et al. ..... 417/214
4,248,265 A * 2/1981 Freeman, Jr. ..... 137/494
4,300,509 A * 11/1981 Schechter ..... 123/499
4,404,944 A * 9/1983 Yamazaki et al. ..... 123/458
4,419,976 A * 12/1983 Hosaka ..... 123/458
4,432,327 A * 2/1984 Salzgeber ..... 123/502
4,449,506 A * 5/1984 Drutchas ..... 123/458
4,481,926 A * 11/1984 Miki et al. ..... 123/463
4,597,407 A * 7/1986 Smith ..... 137/468
4,606,322 A * 8/1986 Reid et al. ..... 123/575
4,621,604 A * 11/1986 Abthoff et al. ..... 123/446
4,774,923 A * 10/1988 Hayashi ..... 123/463
4,791,954 A * 12/1988 Hasegawa ..... 137/487.5
4,860,787 A * 8/1989 Grosselin ..... 137/487.5
4,872,437 A * 10/1989 Asayama ..... 123/463
4,958,706 A * 9/1990 Richardson et al. ..... 188/319.1
5,035,223 A * 7/1991 Watanabe ..... 123/459
5,035,357 A * 7/1991 Brickell et al. ..... 239/156
5,085,193 A * 2/1992 Morikawa ..... 123/458
5,367,999 A * 11/1994 King et al. ..... 123/458
5,381,816 A * 1/1995 Alsobrooks et al. ..... 137/15.22

(Continued)

*Primary Examiner* — Thomas Moulis

(74) *Attorney, Agent, or Firm* — Allan J. Lippa; Alleman Hall McCoy Russell & Tuttle LLP

(57) ABSTRACT

A method for operating an engine direct injection fuel system is provided. The direct injection fuel system includes a mechanical fuel pressure regulator that has a spring actuatable by an electric motor. The method includes adjusting a preload of the spring by operating the electric motor to adjust a set-point fuel pressure from a first set-point fuel pressure to a second set-point fuel pressure in response to an operating condition, and maintaining the preload of the spring mechanically when the electric motor is not operating.

20 Claims, 5 Drawing Sheets

U.S. PATENT DOCUMENTS 5,435,343 A * 7/1995 Buezis ..... 137/489
5,450,873 A * 9/1995 Palmer ..... 137/114
5,509,390 A * 4/1996 Tuckey ..... 123/463
5,558,063 A * 9/1996 Minagawa et al. ..... 123/457
5,718,207 A * 2/1998 Ito ..... 123/497
5,727,525 A * 3/1998 Tsuzuki ..... 123/447
5,758,622 A * 6/1998 Rembold et al. ..... 123/456
5,758,684 A * 6/1998 Hudson et al. ..... 137/269
5,797,374 A * 8/1998 Minagawa et al. ..... 123/497
5,878,718 A 3/1999 Rembold et al.
5,967,119 A * 10/1999 Burkhard et al. ..... 123/458
6,021,763 A * 2/2000 Yoshihara et al. ..... 123/516
6,067,963 A * 5/2000 Oi et al. ..... 123/458
6,119,655 A * 9/2000 Heinitz et al. ..... 123/447
6,123,093 A * 9/2000 D'Antonio et al. ..... 137/78.3
6,155,234 A * 12/2000 Hartke et al. ..... 123/459
6,283,145 B1 * 9/2001 Fenn ..... 137/489
6,298,828 B1 * 10/2001 Concialdi ..... 123/457
6,408,822 B1 * 6/2002 Rembold et al. ..... 123/447
6,409,145 B1 * 6/2002 Fong et al. ..... 251/129.18
6,505,608 B2 1/2003 Hiraku et al.
6,604,538 B2 * 8/2003 Schmotzer et al. ..... 137/1
6,688,321 B2 * 2/2004 Palmer ..... 137/15.19
6,840,219 B2 1/2005 Joos et al.
6,889,656 B1 5/2005 Rembold et al.
6,895,995 B2 * 5/2005 Kirkman et al. ..... 137/501
6,971,628 B2 * 12/2005 Ichimaru ..... 251/129.11
7,040,291 B2 * 5/2006 Veit ..... 123/458
7,066,149 B1 * 6/2006 Date et al. ..... 123/457
7,441,545 B1 * 10/2008 Fisher et al. ..... 123/467
7,607,638 B2 * 10/2009 Wilson et al. ..... 251/129.11
7,699,146 B1 * 4/2010 Becker et al. ..... 188/275
7,775,191 B2 * 8/2010 Hou ..... 123/458
2011/0108130 A1 * 5/2011 Schultz et al. ..... 137/14

* cited by examiner

FUEL SYSTEM WITH ELECTRICALLY-CONTROLLABLE MECHANICAL PRESSURE REGULATOR

CROSS-REFERENCE TO RELATED APPLICATIONS

This application claims priority from U.S. Provisional Patent Application No. 61/222,216, entitled "Fuel System with Electrically-Controllable Mechanical Pressure Regulator," filed Jul. 1, 2009, the disclosure of which is hereby incorporated by reference in its entirety and for all purposes.

BACKGROUND AND SUMMARY

Many internal combustion engines utilize Gasoline Direct Injection (GDI) to increase the power efficiency and range over which the fuel can be delivered to the cylinder. One potential issue with GDI is that under lower fuel pressures the fuel may not sufficiently mix with the air in the cylinder. Insufficient mixing may decrease engine power and efficiency, and increase emissions, at least under some conditions. For example, during cold engine starts, and before the catalytic converter is activated, insufficient mixing as a result of lower fuel pressure may exacerbate cold start emissions.

In one example, a fuel delivery system includes a lower pressure fuel pump and a high pressure fuel pump in combination to achieve a higher fuel pressure. However, at startup the two-pump system may require a longer duration to pump fuel at the higher fuel pressure, which may result in engine miss-starts. Further, the slow response time of the fuel pumps may allow for pulsations in fuel pressure to cause inaccurate amounts of fuel to be injected for combustion. Moreover, the consistently higher fuel pressure may cause increased wear on components of the fuel delivery system.

One approach to provide variable fuel pressure during vehicle operation may include utilizing a method for operating an engine direct injection fuel system including a mechanical fuel pressure regulator that has a spring actuatable by an electric motor. The method includes adjusting a preload of the spring by operating the electric motor to adjust a set-point fuel pressure from a first set-point fuel pressure to a second set-point fuel pressure in response to an operating condition, and maintaining the preload of the spring mechanically when the electric motor is not operating.

By implementing a mechanical fuel pressure regulator having a spring preload that may be mechanically maintained and adjusted via operation of an electric motor, fuel pressure pulsations may be compensated for quickly and a set-point fuel pressure may be adjusted dynamically during various operating conditions. In this way, fuel pressure may be regulated consistently, which in turn may improve fuel injection accuracy. Moreover, the electric motor of the fuel pressure regulator may be operated to adjust the spring preload and then the adjusted spring preload may be maintained mechanically. By only operating the electric motor to make spring preload adjustments energy consumption may be reduced and durability may be improved.

Another approach to provide temporarily increased fuel pressure for engine starting may be a method for operating a fuel system of a vehicle utilizing gasoline direct injection for an internal combustion engine, the fuel system including at least one fuel pump, a fuel pressure regulator fluidly coupled to the at the least one fuel pump, the mechanical fuel pressure regulator having a spring actuatable by an electric motor, the method comprising: increasing a preload of the spring of the mechanical fuel pressure regulator by operating the electric motor to set a first set-point fuel pressure in response to an engine shutdown condition; activating the at least one fuel pump to increase a fuel pressure to the first set-point fuel pressure in response to an engine start condition following the engine shutdown condition; and decreasing the preload of the spring of the mechanical fuel pressure regulator by operating the electric motor to adjust the first set-point fuel pressure to a second set-point fuel pressure that is lower than the first set-point fuel pressure in response to exceeding a threshold after engine start.

By increasing the spring preload and maintaining it in preparation for the next engine start, the set-point fuel pressure may already be established and activation of the low pressure pump flow may be dedicated to replenishing the high pressure pump immediately instead of waiting for set-point fuel pressure adjustment at startup (e.g., key-on) for quicker fueling and engine starting. This approach may provide faster closed loop fuel pressure control during startup and during low engine fuel consumption conditions. Moreover, by utilizing a preload of a spring in the fuel pressure regulator to adjust fuel pressure, the fuel pressure set-point may be decreased after startup to reduce wear on fuel delivery system components. In this way, the operational lifetime of the fuel delivery system may be increased. The above described approaches may provide high control accuracy to dynamically adjust the set-point fuel pressure whether it be to dampen pressure pulsations during vehicle operation or to enable quicker and more robust engine starts.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION

DETAILED DESCRIPTION

The present disclosure is related to a fuel system for a vehicle having an electrically controllable mechanical fuel pressure regulator, as well as methods for controlling the electrically controllable mechanical fuel pressure regulator to make fuel injection more accurate and robust. The approaches may provide fast closed loop fuel pressure regulation with the use of a mechanical pressure regulator. Further, commanding the fuel pressure to a designated set-point may be performed in a simple manner by positioning a spring preload of the mechanical fuel pressure regulator. Further still, such an approach may reduce or eliminate the need for damper components in the fuel system which may reduce costs of the fuel system. Further still, by operating the electric motor when adjusting the set-point fuel pressure and mechanically maintaining the set-point, the mechanical fuel pressure regulator component life may be improved relative to a fuel pressure regulator that maintains the set-point via other operation(s).

Figure 1:
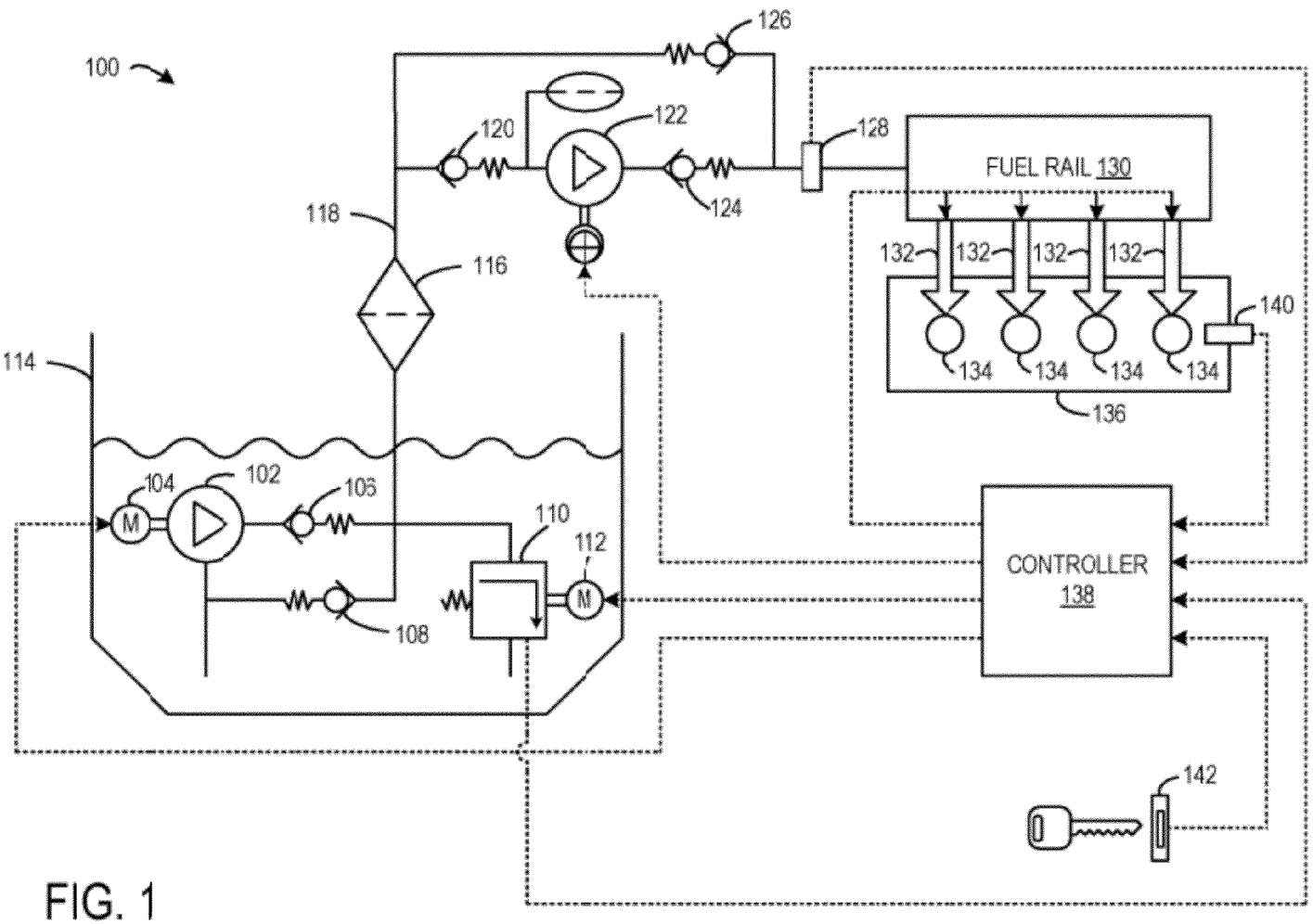
FIG. 1 shows a schematic diagram of an example fuel delivery system.

FIG. 1 shows a schematic depiction of a fuel delivery system 100 for an internal combustion engine that utilizes gasoline direct injection (GDI) for use in a vehicle. FIG. 1 is used to represent a complete GDI system schematic. The illustrated embodiment includes two fuel pumps coupled in series to provide highly pressurized fuel to fuel injectors for fuel injection. However, other direct injection fuel system regimes may be implemented within the scope of the present disclosure.

Fuel delivery system 100 includes fuel pump 102 to pump liquid fuel from fuel tank 114. In this embodiment, fuel pump 102 is electronically controlled via a variable speed electric motor 104. In some cases, fuel pump 102 may only operate at a limited number of speeds. It will be appreciated that the fuel tank may contain any fuel suitable for an internal combustion engine such as gasoline, methanol, ethanol, or any combination thereof.

Fuel pump 102 is fluidly coupled to delivery check valve 106 to facilitate fuel delivery and maintain fuel line pressure. In particular, delivery check valve 106 includes a ball and spring mechanism that seats and seals at a specified pressure differential to deliver fuel downstream. A return check valve 108 may be fluidly coupled with delivery check valve 106. The return check valve 108 may be positioned to facilitate delivery of fuel returning to fuel tank 114. In some embodiments, fuel delivery system 100 may include a series of check valves fluidly coupled to fuel pump 102 to further impede fuel from leaking back upstream of the valves.

A fuel pressure regulator 110 may be fluidly coupled to delivery check valve 106 and return check valve 108. Fuel pressure regulator 110 may regulate pressure of an amount of fuel in downstream line 118 to high pressure fuel pump 122. The fuel pressure regulator 110 may be a mechanical fuel pressure regulator that is electrically controllable via electric motor 112. The electric motor 112 may be configured to adjust a spring preload of the mechanical fuel pressure regulator in order to adjust a set-point fuel pressure at which the mechanical fuel pressure regulator regulates fuel pressure downstream as operating conditions vary. For example, as discussed above the set-point fuel pressure may be increased at engine shutdown in preparation for the very next engine cold start condition where the increased fuel pressure may facilitate in-cylinder-air-fuel mixing for more complete combustion which may create heat used to warm emission control device(s) to a light-off temperature. After engine start, the motor may be controlled to lower the set-point fuel pressure for vehicle operation. Excess fuel beyond what is used to maintain the fuel pressure at the set-point may be returned by fuel pressure regulator 110 to fuel tank 114.

The electric motor may interface with the mechanical fuel pressure regulator such that electrical energy does not have to be used during constant pressure conditions. Electrical energy is only used to operate the motor for spring preload adjustment. Accordingly, electrical energy usage may be reduced relative to other electrically controlled fuel pressure regulator configurations that require constant usage of electrical energy to maintain a set-point fuel pressure at which fuel pressure is regulated. The electrically controlled fuel pressure regulator will be discussed in further detail below with reference to FIG. 2.

Continuing with FIG. 1, the delivery check valve 106, return check valve 108 and, mechanical fuel pressure regulator 110 are fluidly coupled upstream from fuel filter 116. Fuel filter 116 may remove small impurities that may be contained in the fuel that could potentially damage engine components. In some embodiments, the fuel pressure regulator may be coupled downstream from the fuel filter. Fuel may be delivered from fuel filter 116 downstream to high pressure fuel pump 122.

Fuel delivery system 100 may include a series of check valves fluidly coupled to high pressure fuel pump 122 to further impede fuel from leaking back upstream in the case of fuel delivered to the fuel injectors or downstream in the case of fuel returned to the fuel tank. In particular, intermediate check valve 120 may be positioned upstream from high pressure fuel pump 122 to inhibit fuel from flowing upstream. A downstream delivery check valve 124 may be fluidly coupled downstream of high pressure fuel pump 122 to inhibit fuel from flowing back upstream to the high pressure fuel pump. A downstream return check valve 126 may be fluidly coupled to permit fuel not used for fuel injection to return back upstream to fuel tank 114.

In some embodiments, a fuel sensor 128 may positioned downstream of high pressure fuel pump 122 to sense fuel pressure and or temperature at fuel rail 130. In some embodiments, pressure sensing may be performed by fuel pressure regulator 110, in addition to or in place of the fuel sensor.

The illustrated two-pump system may be used deliver fuel to fuel rail 130. In particular, fuel pump 102 may not have the capability to pump fuel at a desired operational pressure. Thus, the two-pump system may include low pressure pump (or lift pump) 102 to initially pump fuel out of the fuel tank and into the fuel line. Further, fuel may flow through high-pressure pump 122 to increase the fuel pressure to the operational pressure or injection pressure. It will be appreciated that, in some embodiments, the fuel delivery system may include one or more additional fuel pumps pressure regulator (s), check valve(s), and/or return line(s) to further regulate and/or adjust fuel pressure.

Fuel rail 130 may distribute fuel regulated at a set-point fuel pressure by fuel pressure regulator 110 to each of a plurality of fuel injectors 132. Each the plurality of fuel injectors 132 may be positioned in a corresponding cylinder 134 of engine 136 such that during operation of fuel injectors 132 fuel is injected directly into each corresponding cylinder 134. Alternatively (or in addition), engine 136 may include fuel injectors positioned at the intake port of each cylinder such that during operation of the fuel injectors fuel is injected in to the intake port of each cylinder. In the illustrated embodiment, engine 136 includes four cylinders. However, it will be appreciated that the engine may include a different number of cylinders.

Controller 138 may receive various signals from sensors coupled to fuel delivery system 100 and engine 136. For example, controller 138 may receive a fuel pressure (and/or temperature) signal from fuel sensor 128 which may be positioned downstream of fuel pressure regulator. In some cases, fuel pressure measured by fuel sensor 128 may be indicative of fuel rail pressure. In some embodiments, a fuel sensor may be positioned upstream from fuel pressure regulator 110 to measure a pressure of fuel exiting fuel pump 102. Further, controller 122 may receive engine/exhaust parameter signals from engine sensor(s) 140. For example, these signals may include measurement of inducted mass air flow, engine coolant temperature, engine speed, throttle position, absolute manifold pressure, air/fuel ratio, throttle position, emission control device temperature, etc. Note that various combinations of the above measurements as well as measurements of other related parameters may be sensed by sensor(s) 140. Further, as another example, controller 138 may receive an engine start/shutdown indication signal from start sensor 142. It will be appreciated that the controller may receive other signals indicative of vehicle operating conditions.

Controller 138 may provide feedback control based on signals received from fuel sensor 128, engine sensor(s) 140, and/or start sensor 142, among others. For example, controller 138 may send signals to adjust an operation speed of fuel pump 102 via signals to electric motor 104 (as well as signals a motor of high pressure fuel pump 122), a fuel pressure set-point of fuel pressure regulator 110 via signals to electric motor 112, and/or a fuel injection amount and/or timing based on signals from fuel sensor 128 (or fuel pressure provided from fuel pressure regulator 110), engine sensor(s) 140, start sensor 142, or a combination thereof.

In one example controller 138 is a microcomputer that includes a microprocessor unit, input/output ports, an electronic storage medium for executable programs and calibration values such as read only memory, random access memory, keep alive memory, and a data bus. The storage medium read-only memory can be programmed with computer readable data representing instructions executable by the processor for performing the method described below as well as other variants that are anticipated but not specifically listed.

Figure 2:
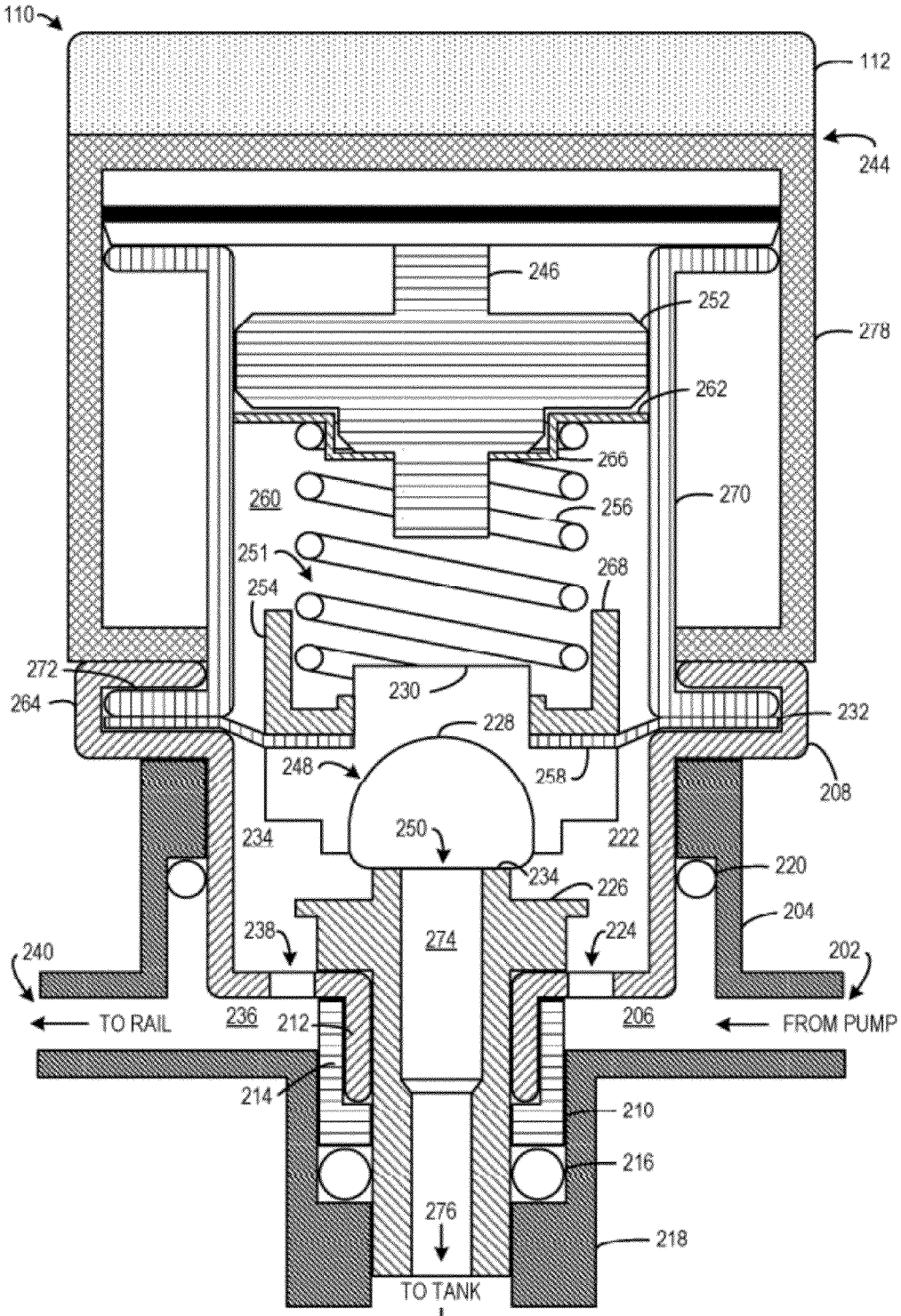
FIG. 2 shows a sectional view of an example fuel pressure regulator having an electric motor to adjust a spring preload to vary a fuel pressure set-point of the fuel pressure regulator.

FIG. 2 shows a sectional view of an example embodiment of fuel pressure regulator 110 that may be utilized in fuel delivery system 100 of FIG. 1. Fuel pressure regulator 110 may receive fuel from fuel pump 102 of FIG. 1 through inlet 202 of exterior body 204 into inlet chamber 206. Inlet chamber 206 is defined by exterior body 204, intermediate retainer 208, and seat-retainer ring 210. In particular, intermediate retainer 208 may include down-turned portion 212 that interlocks with up-turned portion 214 of seat-retainer ring 210 to form a lower portion of inlet chamber 206. Seat-retainer ring 210 may sit on lower gasket 216 that rests on sleeve 218 of exterior body 204. Lower gasket 216 may fluidly seal a lower portion of inlet chamber 206 to inhibit fuel from leaking down the interior surface of sleeve 218. Further, upper gasket 220 may fluidly seal an upper portion of inlet chamber 206 where intermediate retainer 208 and exterior body 204 meet.

Fuel may travel from inlet chamber 206 to secondary inlet chamber 222 via interior inlet passage 224 formed by intermediate retainer 208. Secondary inlet chamber 222 is defined by intermediate retainer 208, seal element 226, ground ball 228, armature 230, and diaphragm 232. Fuel may travel from interior inlet chamber 222 to interior outlet chamber 234 through a channel created between seat 234 of seal element 226 and ground ball 228 when ground ball 228 is lifted from seat 234 based on a spring preload that acts on armature 230. Like secondary inlet chamber 222, secondary outlet chamber 234 is defined by intermediate retainer 208, seal element 226, ground ball 228, armature 230, and diaphragm 232. Fuel may flow from secondary outlet chamber 234 to outlet chamber 236 via interior outlet passage 238 formed by intermediate retainer 208. Like inlet chamber 206, outlet chamber 236 is defined by exterior body 204, intermediate retainer 208, and seat-retainer ring 210. Fuel may exit fuel pressure regulator 110 via outlet 240 to high pressure fuel pump 122 and fuel rail 130 of FIG. 1.

Fuel pressure regulator 110 may be configured to regulate fuel pressure at a set-point fuel pressure that may be varied according to electronic control based upon vehicle operating parameters. In particular, fuel pressure regulator 110 includes electric motor 110 that may be electronically coupled to controller 138 of FIG. 1 and may receive control signals that cause actuation of electric motor 110. The operation of electric motor 110 may cause mechanical force exerted on a helical spring 256 or a spring preload to be adjusted. The spring preload may be adjusted to change a position and/or force of an armature 230 in order to adjust the set-point fuel pressure of fuel pressure regulator 110.

Armature 230 longitudinally spans a portion of the interior of fuel pressure regulator 110 to operatively couple to ground ball 228. In particular, armature 230 includes concave portion 248 shaped to substantially encompass ground ball 228 to maintain ground ball 228 resting on seal element 226. Ground ball 228 includes a flat base portion 250 that sits flush on seat 234 of seal element 226 to inhibit fuel from passing directly through fuel pressure regulator 110. Armature 230 may be biased to apply force on ground ball 228 by spring assembly 251.

Spring assembly 251 includes diaphragm 232, spring retainer ring 254, and helical spring 256 collectively stacked on brim 258 of armature 230. Spring assembly 251 is enclosed in spring chamber 260 which is cooperatively defined by cap 262 and diaphragm 232. Diaphragm 232 is shaped to form an axially positioned circular hole having a circumference slightly larger than shaft 246 so that diaphragm 232 surrounds shaft 246. Diaphragm 232 is positioned on and supported by brim 258. Diaphragm 232 extends radially outward from brim 258 at an acute angle relative to the lateral axis of diaphragm 232 and is received in bend portion 264 of intermediate retainer 208. Diaphragm 232 may be flexible to accommodate longitudinal movement of armature 230 upon variation of spring preload due to operation of electric motor 110. Further, diaphragm 232 may fluidly seal spring chamber 260 from secondary inlet chamber 222 and secondary outlet chamber 234 so that fuel does not enter spring chamber 260.

Spring-retainer ring 254 is stacked upon diaphragm 232. Spring-retainer ring 254 is shaped to form a similarly sized central hole to that of diaphragm 232 so that spring-retainer ring 254 surrounds armature 230. Helical spring 256 is stacked upon spring-retainer ring 254. Helical spring 256 extends from spring-retainer ring 254 to cap 262. Cap 262 includes internal rib 266 that extends downward inside the windings of helical spring 256. Spring-retainer ring 254 includes circumferentially continuous peripheral rib 268 that extends upward to surround some windings of helical spring 256. Internal rib 266 and peripheral rib 268 cooperatively maintain helical spring 256 longitudinally aligned with armature 230 such that upon compression/extension, helical spring 256 may be inhibited from lateral or pivotal movement within spring chamber 260.

Spring chamber 260 is enclosed by diaphragm 232, cap 262, and sidewall 270. Sidewall 270 has a diameter that is substantially the same size as the diameter of a middle region of intermediate retainer 208 so that sidewall 270 and intermediate retainer 208 are longitudinally aligned. Sidewall 270 includes flange 272 that is stacked upon an edge region of diaphragm 232. Flange 272 and diaphragm 232 are surrounded by bend portion 264 of intermediate retainer 208 to retain diaphragm 232 and sidewall 270 in place.

Cap 262 including internal rib 266 forms an axially positioned circular hole through which a compression nut 252 extends. Compression nut 252 may rest on the exterior of cap 262 and may substantially extend laterally to sidewall 270. Compression nut 252 may include a shaft 246 that extends upward and couples to electric motor 110 via drive interface 244. Drive interface 244 may be supported by housing 278. Shaft 246 and/or drive interface may extend through housing 278 to electric motor 110. Electric motor 110 may be secured to housing 278 and may collectively form an upper portion of fuel pressure regulator 110 such that the electric motor is integrated into the upper portion of the housing (or body) of the fuel pressure regulator.

Operation of electric motor 110 may cause rotation of shaft 246 such that the shaft rotates downward in the longitudinal direction. The extension of shaft 246 may cause compression nut 252 to exert force on cap 262 and helical spring 256 causing the spring preload. Further, helical spring 256 may be adapted to exert spring force on cap 262 and brim 258 of armature 230 via spring-retainer ring 254 and diaphragm 232 that is further exerted on ground ball 228 to maintain ground ball 228 flush on seal element 226 to inhibit fuel from flowing directly through fuel pressure regulator 110.

As discussed above, electric motor 110 may be operated via signals from controller 138 to change the spring load in order to adjust the set-point fuel pressure at which the fuel pressure regulator regulates fuel pressure. For example, electric motor 110 may be operated to rotate shaft 246 downward so that compression nut 252 compresses helical spring 256 to increase the spring preload and thus increase the set-point fuel pressure. Likewise, electric motor 110 may be operated to rotate shaft 246 upward in the longitudinal direction to raise compression nut 252 so that helical spring 256 extends and the spring preload is reduced, thus reducing the set-point fuel pressure. In one example, the electric motor operates in a first direction to move the compression nut towards the seal element and operates in a second direction to move the compression nut away from the seal element when the electric motor. Due to the mechanical nature in which the electric motor interfaces with the fuel pressure regulator, operation of the electric motor only occurs to change the position of the compression nut. In other words, the electric motor is only operated to changes the set-point fuel pressure. Otherwise the electric motor does not operate and the preload of the spring and the set-point fuel pressure are maintained mechanically via the drive interface including the compression nut, shaft, and worm drive.

In order for fuel to flow through fuel pressure regulator 110, the fuel pressure must be great enough to overcome the spring preload such that ground ball 228 may be lifted from seat 234 and fuel may flow through a channel created between ground ball 228 and seal element 226. Furthermore, excess fuel beyond what is used to maintain fuel flow through outlet 240 at the set-point fuel pressure may be forced to flow down return passage 274 of seal element 226. Return passage 274 may be internal to seal element 226 and may be tapered and cylindrical in shape. Return passage may form a return outlet 276 through which excess fuel may be returned to fuel tank 114 of FIG. 1.

The electric motor may be combined with the adjustable spring preload to have fast mechanical pressure regulator response to fuel pressure pulsations while also having the ability to adjust the fuel pressure set-point. The speed of mechanical fuel pressure regulation may be capable of filtering fuel pressure pulsations without changing the fuel pressure set-point, in certain frequency ranges. Further, set-point positioning may not need to have as fast of a response. The sensitivity of the regulator to change the set-point can be designed such that even relatively slow (slow motor response relative to the mechanical pressure regulator speed), reaction can be sensed by the mechanical fuel pressure regulator. In particular, this membrane type mechanical fuel pressure regulator with small mass and a stiff spring can have high frequency response. As such, the fast response is compensated by mechanical pressure regulator reaction, while the set-point could be adjusted at a slower rate.

For example, pressure pulsation could be in the range of 50 to 300 Hz fundamental frequency. As such, transient time for closed loop DC motor control to adjust the set-point may be 0.1 seconds. This transient time considers DC motor control to be from 0 to max revolutions per minute (RPM). In some operating conditions, the electric motor will not need to operate at max RPM to adjust the set-point. In this case reaction time may be faster than 0.1 seconds. Consequently, this configuration, in certain frequency ranges, offers opportunity to compensate some pressure pulsation mechanically alone or in combination with a set-point change. Moreover, transient response time may be reduced further by implementation of the worm gear, which may allow the speed of the motor to be reduced and torque to be increased.

By integrating electric motor 110 into fuel pressure regulator 110, the preload of helical spring 256 may be precisely controlled so that force applied to seal element 226 may be varied on demand, thereby allowing the system to adjust the set pressure to a desired value to meet engine operating conditions. Moreover, the electric motor and/or drive interface may be configured to permit the spring preload to be held in place mechanically so that electrical energy is only used to adjust the spring preload. Accordingly, electrical energy consumption may be reduced relative to a configuration in which electrical energy is used to maintain a set-point fuel pressure. Further still, since electrical energy is used during transient adjustment conditions this configuration may have a high potential to achieve high durability.

Figure 3:
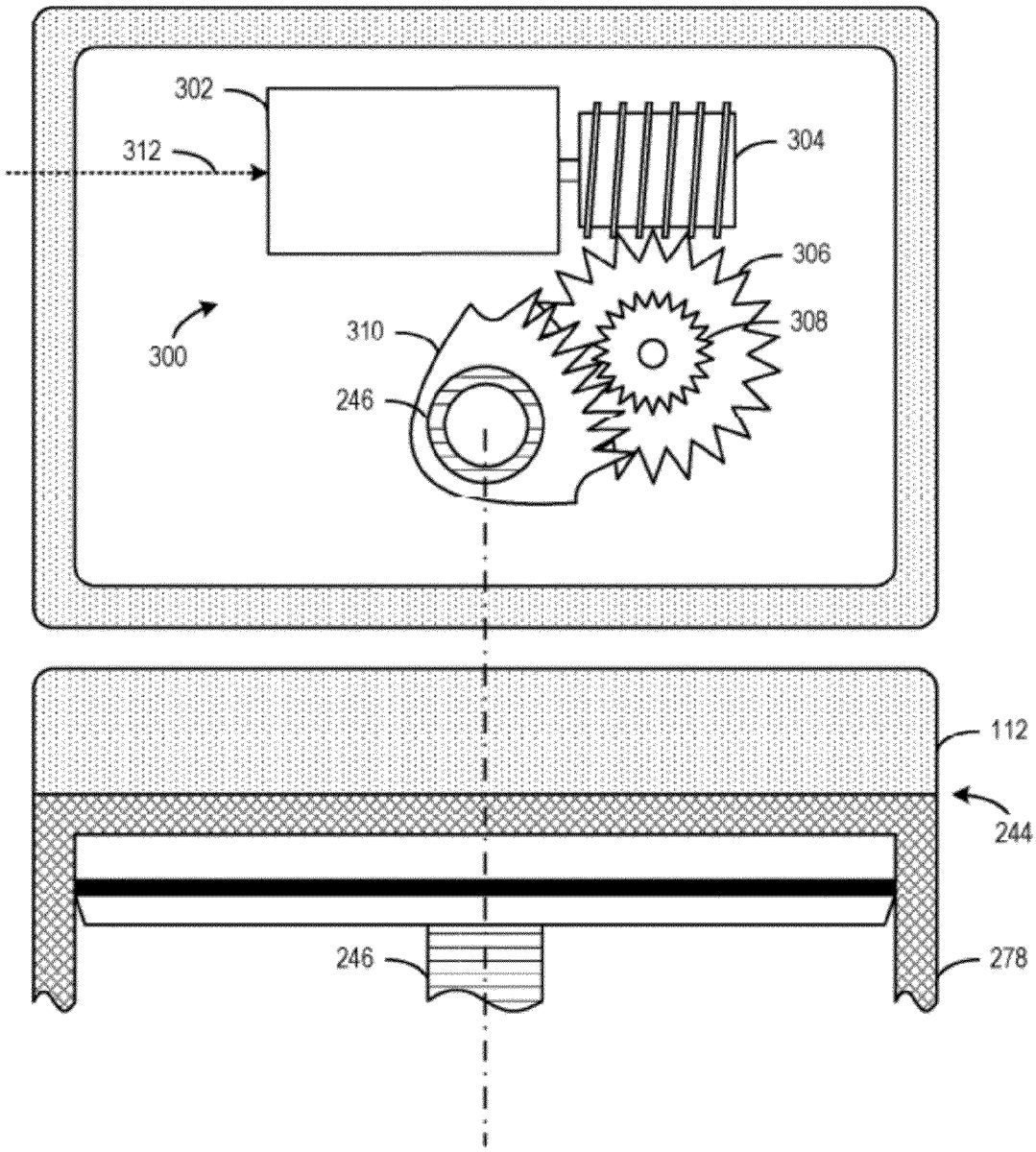
FIG. 3 shows a partial sectional view of an interface between the electric motor and fuel pressure regulator of FIG. 2.

FIG. 3 shows a partial sectional view of an interface between electric motor 110 and fuel pressure regulator 110 of FIG. 2. More particularly, FIG. 3 shows a bottom view of electric motor 110 juxtaposed with a partial sectional view where the electric motor interfaces with an upper portion of fuel pressure regulator 110. As discussed above, drive interface 244 may be supported by housing 278. a worm drive coupled to an output of the electric motor;

a shaft coupled to the worm drive; and a compression nut coupled to the shaft and positioned to maintain the preload on the spring, where operation of the electric motor changes the state of the drive interface by activating the worm drive to rotate the shaft and change the position of the compression nut to vary the preload on the spring.

Shaft 246 and/or drive interface may extend through housing 278 to electric motor 110. Electric motor 110 may be secured to housing 278 and may collectively form an upper portion of fuel pressure regulator 110 such that the electric motor 110 is integrated into fuel pressure regulator 110.

Electric motor 110 may be configured to provide electrical energy to rotate shaft 246 in order to change the position/force of compression nut 252 (shown in FIG. 2). By changing the position/force of compression nut 252 the force exerted on helical spring 256, the spring preload may be adjusted which in turn adjusts the set-point fuel pressure of fuel pressure regulator 110. Fuel pressure regulator 110 may be configured such that electric motor 110 may only be operated to change the spring preload/set-point fuel pressure. Accordingly, electrical energy is only used during transient conditions to when the set-point fuel pressure is adjusted. In this way, electrical energy consumption may be reduced and operational life of the fuel pressure regulator may be extended.

In the illustrated embodiment, Electric motor 110 may include a direct current (DC) motor 302 that couples to drive interface 244. Drive interface 244 may include a worm drive 300 coupled to an output of DC motor 302 that may be operated to rotate a worm 304. Worm 304 may interface with a worm gear 306. An intermediate gear 308 may be coupled to worm gear 306 to reduce a torque ratio of worm gear 306. Intermediate gear 308 may interface with a drive gear 310. Drive gear 310 may be coupled to shaft 246. Operation of DC motor 302 may produce torque that rotates worm 304 that causes rotation of worm gear 306, which in turn causes rotation of intermediate gear 308, drive gear 310, and ultimately shaft 246. DC motor 302 may be bidirectional so that shaft 246 may be rotated longitudinally upward or downward to decrease or increase the spring preload and the set-point fuel pressure.

DC motor 302 may be in communication with controller 138 (shown in FIG. 1) and may receive signals 312 from controller 138 that control operation of DC motor 302. The control signals 312 may command adjustment of the set-point fuel pressure in order to accommodate transients in fuel pressure that occur during vehicle operation. In other words, the set-point fuel pressure may be adjusted to dampen pulsations in fuel pressure in order to facilitate consistent amounts of fuel to be injected by fuel injectors 132 (shown in FIG. 1). Moreover, the set-point fuel pressure may be adjusted to adjust fuel pressure for specified operating conditions. For example, for an engine cold start condition, DC motor may be operated to set the spring preload to a higher set-point fuel pressure. The higher fuel pressure may facilitate more complete combustion that increases heat provided to cylinder walls as well as to the vehicle exhaust system to heat one or more emission control devices to a light-off temperature. Further, upon the engine and/or emission control device being heated to a suitable operating temperature, the DC motor may be operated to set the spring preload to a lower set-point fuel pressure for normal vehicle operation.

It will be appreciated that the electric motor may be coupled to the shaft in any suitable manner that permits the spring preload to be maintained mechanically and adjusted via operation of the electric motor. In some embodiments, the worm drive may include more or less gears. In some embodiments, the electric motor may be coupled in a manner in which a worm drive is omitted. Further, the fuel pressure regulator may be adapted to output virtually any suitable fuel pressure for a duration based upon the dimensions of the flow restriction passage, low-side chamber, and high-side chamber, as well as the spring force characteristics of the helical spring, and the electric motor.

Figure 4:
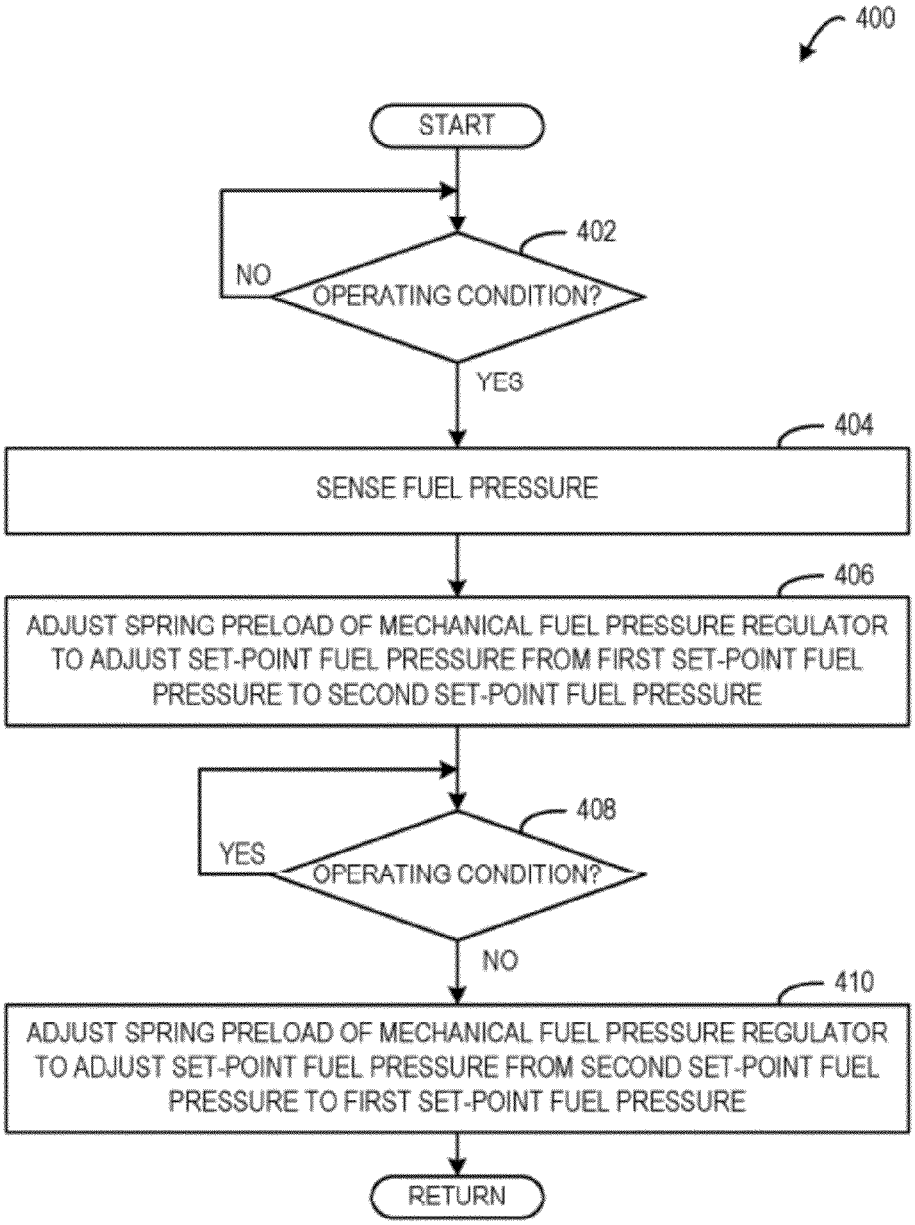
FIG. 4 shows a flow diagram of an example embodiment of a method for operating the fuel delivery system to vary a set-point fuel pressure during vehicle operation.

FIG. 4 shows a flow diagram of an example of an embodiment of a method 400 for operating the fuel delivery system to vary a set-point fuel pressure during vehicle operation. Method 400 begins at 402, where the method may include determining if there is an indication of an operating condition. The operating condition may include a change in one or more operating parameters that indicate a fluctuation in fuel pressure that would cause fuel pressure pulsations. For example, the operation condition may occur based on a change in one or more of throttle position, air/fuel ratio, commanded lean or rich engine operation, cylinder deactivation, deceleration fuel shut off (DFSO) mode, engine startup, engine shutdown, etc. The change in operating parameter(s) may be determined based on signals received from fuel sensor 128, engine sensor 140, start sensor 142 and/or another vehicle sensor that provides an indication of an operating parameter that is sent to controller 138 (shown in FIG. 1). If the operating condition is detected, the method moves to 404. Otherwise the operating condition has not been detected and the method returns to 402.

At 404, the method may include sensing the fuel pressure. In some cases, sensing may include sensing a fuel pressure via the mechanical fuel pressure regulator without use of the fuel sensor. In this case, the fuel pressure may be derived from the spring preload of the mechanical fuel pressure sensor. In some cases, the fuel pressure sensor may be sensed by fuel sensor 128 (shown in FIG. 1). As discussed above, in some embodiments, fuel sensor 128 may be omitted from the fuel system and fuel pressure may be provided via the mechanical fuel pressure regulator.

At 406, the method may include adjusting the spring preload of the fuel pressure regulator to adjust the set-point fuel pressure from a first set-point fuel pressure to a second set-point fuel pressure in response to the operating condition. The preload of the spring may be adjusted by operating the electric motor. In one example, the electric motor is operable in a first direction to increase the preload on the spring and operable in a second direction to decrease the preload of the spring. Depending on the determined operating condition, the spring preload may be increased or decreased to accommodate a fuel pressure pulsation that causes a decrease or increase in fuel pressure. For example, a rapid change in throttle position may cause a pulsation that causes a drop in fuel pressure. Accordingly, the preload of the spring may be increased to increase the set-point fuel pressure to compensate for the pulsation. Once the set-point has been adjusted via operation of the electric motor, the adjusted set-point fuel pressure may be mechanically maintained when the electric motor is not operating. As discussed above, in some embodiments, the set-point fuel pressure may be mechanically maintained by a drive interface that includes a worm drive that positions a shaft having a compression nut at a position, as specified by operation of the electric motor, against the spring to maintain the preload of the spring.

At 408, the method may include determining if the operating condition exists. If the operating condition exists, the method returns to 408. Otherwise, the operating condition no longer exists and the method moves to 410.

At 410, the method may include adjusting the spring preload of the mechanical fuel pressure regulator to adjust the set-point fuel pressure from the second set-point fuel pressure to the first set-point fuel pressure. The set-point fuel pressure may be mechanically maintained at a default fuel pressure for standard vehicle operation and may be temporarily adjusted to a different set-point fuel pressure and mechanically maintained to compensate for transient fuel pressure pulsations or other operating conditions and then returned to and mechanically maintained at the default fuel pressure. In some embodiments, the set-point fuel pressure may be adjusted without sensing the fuel pressure. This adjustment may be performed by tracking the position of the gear/shaft of the drive interface via controller 138 (shown in FIG. 1) to derive the fuel pressure.

The above method may provide fast closed loop fuel pressure control in a fuel delivery system that implements a mechanical fuel pressure regulator. That is, the mechanical fuel pressure regulator may be operated in a manner that is fast enough to compensate for pulsations in fuel pressure. Accordingly, fuel pressure pulsations may be dampened and a consistent amount of fuel may be provided to the fuel injectors.

Furthermore, in the above method, fuel pressure regulation is performed simply by adjusting the spring preload of the mechanical fuel pressure regulator. Moreover, due to the manner in which the electric motor interfaces with the helical spring in the fuel pressure regulator, high fuel pressure control accuracy may be achieved through operation of the DC motor. In addition, the sensitivity of the mechanical fuel pressure regulator may be adjusted to different accommodate different fuel pressure operating ranges through design of the mechanical components of the mechanical fuel pressure regulator.

Figure 5:
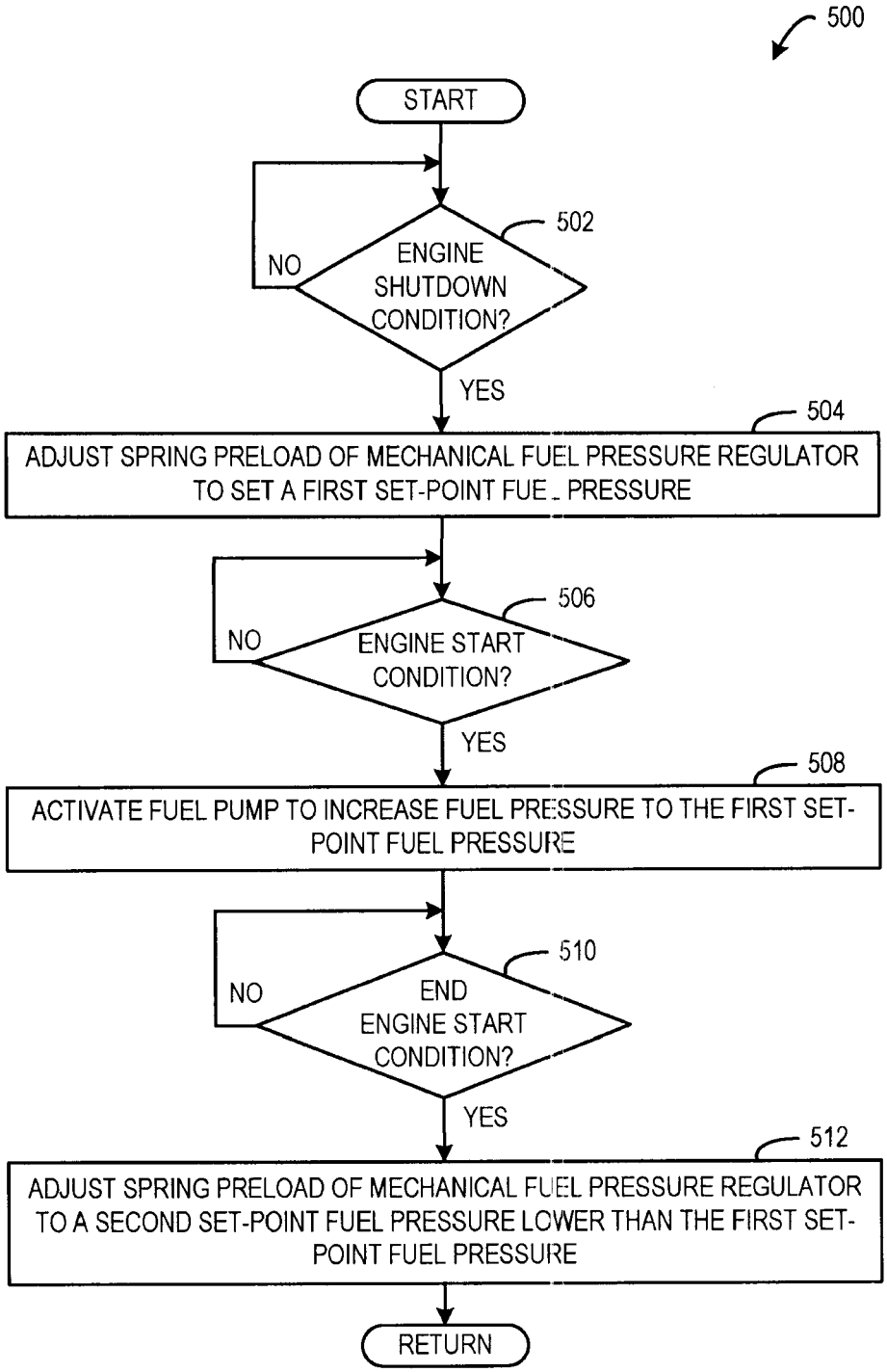
FIG. 5 shows a flow diagram of an example embodiment of a method for operating the fuel delivery system to temporarily provide increased fuel pressure at engine startup.

FIG. 5 shows a flow diagram of an example embodiment of a method 500 for operating the fuel delivery system to temporarily provide increased fuel pressure at engine startup. Method 500 begins at 502, where the method may include determining if there is an indication of engine shutdown. The engine shutdown condition may cease engine cranking and cease ignition for combustion. In one example, the indication of engine shutdown is a key-off signal received from start sensor 142 (shown in FIG. 1) in response to a vehicle operator turning a key to place an ignition switch in the key-off sate. If it is determined that an engine shutdown condition occurs, the method moves to 504. Otherwise, it is determined that an engine shutdown condition does not occur, and the method returns to 502.

At 504, the method may include adjusting a spring preload of the mechanical fuel pressure regulator to set a first set-point fuel pressure in preparation for a very next engine start condition. The first set-point fuel pressure may be any suitable fuel pressure at which complete combustion occurs, which may produce heat for engine and/or emissions control device warming. In one example, the first set-point fuel pressure is set at 80 pounds per square inch (psi) or more. The first set-point fuel pressure may be set higher than a set-point fuel pressure used during standard vehicle operation. In other words, the spring preload may be increased from a spring preload used during standard vehicle operation for the engine start condition and subsequently the spring preload may be decreased back to the spring preload for standard vehicle operation when the start condition ends.

In one example, as shown in FIG. 2, the spring preload may be adjusted by operating electric motor 110 via control signals from controller 138 of FIG. 1 to rotate shaft 246 to change a position/force of compression nut 252. The change in position/force may cause a spring preload via helical spring 256 that causes armature 230 to change the position and/or pressure of ground ball 228 relative to seal element 226 to increase the pressure of fuel output of fuel pressure regulator 110. Once the spring preload is increased, the increased spring preload may be mechanically maintained by the compression nut when the electric motor is not operating.

At 506, the method may include determining if there is an indication of an engine start condition. The engine start condition may initiate engine cranking and ignition for combustion. In one example, the indication of engine startup is a key-on signal received from start sensor 142 (shown in FIG. 1) in response to a vehicle operator placing a key in an ignition switch and turning the key to place the ignition switch in the key-on state. In some embodiments, the engine start condition may take into consideration engine temperature and/or emissions control device temperature to selectively adjust the fuel pressure set-point at which the mechanical fuel pressure regulator regulates fuel pressure. For example, if the engine is shutdown for a short period of time at which the engine remains warm, the fuel pressure set-point may not be increased for engine warming purposes. If it is determined that an engine start condition occurs, the method moves to 508. Otherwise, it is determined that an engine start condition does not occur and the method returns to 506.

At 508, the method may include activating a fuel pump to increase the fuel pressure to the first set-point fuel pressure. In some cases, a lift pump and/or a high pressure fuel pump may be activated to increase the fuel pressure. Upon reaching the first set-point fuel pressure fuel may be delivered to fuel injectors 132 for injection and combustion.

At 510, the method may include determining if the engine start condition has ended and standard vehicle operation has started. In some embodiments, the determination may be made based on exceeding a threshold after engine start. In some embodiments, the threshold may be a duration since startup of the engine. The predetermined threshold may be a duration for engine combustion to stabilize and/or exhaust system (e.g., emissions control devices) to warm-up. In some cases, the threshold may be measured in units of time. Alternatively, the threshold may be measured in combustion cycles. In some cases, a different unit of measurement may be used. For example, engine temperature and/or emissions control device temperature may be used. If it is determined that the engine start condition has ended, the method moves to 512. Otherwise, it is determined that the engine start condition has not ended, and the method returns to 510.

At 512, the method may include adjusting the spring preload of the mechanical fuel pressure regulator to a second set-point fuel pressure that is lower than the first set-point fuel pressure. In other words, the method may include decreasing the spring preload in response to exceeding a threshold after engine start.

In one example, as shown in FIG. 2, the spring preload may be adjusted by operating electric motor 110 via control signals from controller 138 of FIG. 1 to rotate shaft 246 to change a position/force of compression nut 252. The change in position/force may cause a spring preload via helical spring 256 that causes armature 230 to change the position and/or pressure of ground ball 228 relative to seal element 226 to decrease the pressure of fuel output of fuel pressure regulator 110. Once the spring preload is decreased, the decreased spring preload may be mechanically maintained by the compression nut when the electric motor is not operating.

In some cases, the second pressure set-point may be the fuel pump pressure (e.g., high pressure pump) so that the fuel pressure regulator does not increase fuel pressure between the fuel pump and the fuel rail during vehicle operation after the engine start condition (excluding during fuel pulsation transients).

By adjusting the spring preload of the mechanical fuel pressure regulator to a higher set-point fuel pressure at engine shutdown, the fuel delivery system may be prepped to provide fuel at a fuel pressure suitable for engine start so that the engine and/or emissions control device(s) may be warmed quicker and efficient combustion may be achieved quicker. Stated another way, since the fuel pressure set-point is adjusted at shutdown, adjustment of the set-point fuel pressure is not performed at engine start which may shorten the engine start condition.

Moreover, the precise fuel pressure set-point control may enable a lower pressure fuel pump to be used to deliver fuel during standard vehicle operation so that a fuel line backpressure does not build in the fuel delivery system that wears on fuel system components while still handling fuel pressure requirements for engine startup.

Furthermore, in the above method, fuel pressure regulation is performed simply by adjusting the spring preload of the mechanical fuel pressure regulator. Moreover, due to the manner in which the electric motor interfaces with the helical spring in the fuel pressure regulator, high fuel pressure control accuracy may be achieved through operation of the DC motor.

Note the above method may be performed at low fuel flow conditions other than at engine start similar to the other method described above.

Note that the example control and estimation routines included herein can be used with various system configurations. The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein. For example, a fuel system may include multiple fuel pumps, an electronically-controlled fuel pressure regulator having a variable fuel pressure set-point coupled downstream of at least one of the fuel pumps, and a pressure delay device coupled downstream of the fuel pressure regulator.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine direct injection fuel system including a spring actuatable by an electric motor, comprising:

adjusting a preload of the spring by operating the electric motor to adjust a set-point fuel pressure from a first set-point fuel pressure based on an engine shutdown condition to a second set-point fuel pressure in response to an operating condition; and maintaining the preload of the spring mechanically when the electric motor is not operating.

2. The method of claim 1, wherein the first set-point fuel pressure is greater than the second set-point fuel pressure, the first set-point fuel pressure and the second set-point fuel pressure being regulated pressures of a mechanical fuel pressure regulator.

3. The method of claim 1, wherein the operating condition includes exceeding a threshold after engine start and wherein the second set-point fuel pressure is less than the first set-point fuel pressure.

4. The method of claim 3, wherein the threshold is a light-off temperature of an emissions control device.

5. The method of claim 3, wherein the threshold is a predetermined duration.

6. The method of claim 1, wherein the electric motor is operable in a first direction to increase the preload of the spring and operable in a second direction to decrease the preload of the spring.

7. The method of claim 6, wherein the electric motor includes a worm drive to maintain the preload of the spring when the electric motor is not operating.

8. The method of claim 1, further comprising:

adjusting the spring preload of the mechanical fuel pressure regulator by operating the electric motor to adjust the set-point fuel pressure from the second set-point fuel pressure back to the first set-point fuel pressure in response to the operating condition ending.

9. The method of claim 1, wherein the operating condition includes one or more of a change in throttle position, air/fuel ratio, and cylinder deactivation.

10. A method for operating a fuel system of a vehicle utilizing gasoline direct injection for an internal combustion engine, the fuel system including at least one fuel pump, a fuel pressure regulator fluidly coupled to the at the least one fuel pump, and a mechanical fuel pressure regulator having a spring actuatable by an electric motor, the method comprising:

increasing a preload of the spring of the mechanical fuel pressure regulator by operating the electric motor to set a first set-point fuel pressure in response to an engine shutdown condition;

activating the at least one fuel pump to increase a fuel pressure to the first set-point fuel pressure in response to an engine start condition following the engine shutdown condition; and decreasing the preload of the spring of the mechanical fuel pressure regulator by operating the electric motor to adjust the first set-point fuel pressure to a second set-point fuel pressure that is lower than the first set-point fuel pressure in response to exceeding a threshold after engine start.

11. The method of claim 10, wherein the threshold is a light-off temperature of an emissions control device.

12. The method of claim 10, wherein the threshold is a predetermined duration.

13. The method of claim 10, further comprising:

maintaining the preload of the spring of the mechanical fuel pressure regulator when the electric motor is not operating.

14. The method of claim 13, wherein the electric motor includes a worm drive to maintain the preload of the spring when the electric motor is not operating.

15. A mechanical fuel pressure regulator comprising:

a body forming an inlet and an outlet;

a seal element positioned intermediate the inlet and the outlet;

a spring positioned to apply a preload to the seal element;

a drive interface to mechanically maintain the preload on the spring; and an electric motor operable to adjust a state of the drive interface to vary the preload of the spring to vary a set-point fuel pressure at which fuel flows through the outlet based on an engine operating condition.

16. The mechanical fuel pressure regulator of claim 15, wherein the drive interface comprises:

a worm drive coupled to an output of the electric motor;

a shaft coupled to the worm drive; and a compression nut coupled to the shaft and positioned to maintain the preload of the spring, where operation of the electric motor changes the state of the drive interface by activating the worm drive to rotate the shaft and change a position of the compression nut to vary the preload of the spring.

17. The mechanical fuel pressure regulator of claim 15, wherein the electric motor is operable in a first direction to increase the preload of the spring and operable in a second direction to decrease the preload of the spring.

18. The mechanical fuel pressure regulator of claim 17, wherein the compression nut moves towards the seal element when the electric motor is operating in the first direction and the compression nut moves away from the seal element when the electric motor is operating in the second direction.

19. The mechanical fuel pressure regulator of claim 15, wherein the electric motor is integrated into an upper portion of the body.

20. The mechanical fuel pressure regulator of claim 15, further comprising:

a controller in communication with the electric motor, the controller configured to operate the electric motor to adjust the preload of the spring to adjust the set-point fuel pressure from a first set-point fuel pressure to a second set-point fuel pressure in response to an operating condition.

* * * * *